US006347428B1

(12) United States Patent
Shimko et al.

(10) Patent No.: US 6,347,428 B1
(45) Date of Patent: Feb. 19, 2002

(54) HAND-HELD WET/DRY VACUUM

(75) Inventors: David Shimko, Cleveland; Jeffrey M. Kalman, Cleveland Heights; David J. Boll, Lakewood; Michael F. Wright, Stow, all of OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 09/482,164

(22) Filed: Jan. 12, 2000

(51) Int. Cl.[7] ..... A47L 7/00

(52) U.S. Cl. ..... 15/320; 15/344; 15/387; 15/413

(58) Field of Search ..... 15/320, 344, 387, 15/413

(56) References Cited

U.S. PATENT DOCUMENTS

| | | | | |
|---|---|---|---|---|
| 4,776,058 | A | 10/1988 | Garner et al. | 15/320 |
| 4,788,738 | A | 12/1988 | Monson et al. | 15/320 |
| 4,798,613 | A | 1/1989 | Hetherington et al. | 15/320 |
| 4,821,366 | A | 4/1989 | Levine | 15/344 |
| 4,894,882 | A | 1/1990 | Toya | 15/344 |
| 4,899,418 | A | 2/1990 | Steiner et al. | 15/344 |
| 4,920,608 | A | 5/1990 | Hult et al. | 15/339 |
| 4,924,548 | A | 5/1990 | Touya et al. | 15/347 |
| 4,930,178 | A | 6/1990 | Monson et al. | 15/320 |
| 4,993,106 | A | 2/1991 | Hult et al. | 15/339 |
| 5,005,252 | A | 4/1991 | Steiner et al. | 15/339 |
| 5,025,529 | A | 6/1991 | Hult et al. | 15/344 |
| 5,056,186 | A | 10/1991 | Jiam-Fa | 15/328 |
| 5,341,541 | A | 8/1994 | Sham | 15/320 |
| 5,367,740 | A | 11/1994 | McCray | 15/320 |
| 5,386,612 | A | 2/1995 | Sham | 15/320 |
| 5,507,068 | A | 4/1996 | Fan et al. | 15/320 |
| 5,599,401 | A | 2/1997 | Brosky et al. | 134/21 |
| 5,867,864 | A | 2/1999 | Miller et al. | 15/387 |
| 5,970,572 | A | 10/1999 | Thomas | 15/320 |
| 6,031,969 | A | 2/2000 | Burr et al. | 15/320 |
| 6,125,498 | A | 10/2000 | Roberts et al. | 15/320 |
| 6,134,744 | A | * 10/2000 | Kasen et al. | 15/320 |
| 6,145,159 | A | * 11/2000 | Zahuranec et al. | 15/320 |
| 6,154,917 | A | * 12/2000 | Zahuranec et al. | 15/320 |

* cited by examiner

*Primary Examiner*—Robert J. Warden, Sr.
*Assistant Examiner*—Theresa T. Snider
(74) *Attorney, Agent, or Firm*—Fay, Sharpe, Fagan, Minnich & McKee, LLP

(57) ABSTRACT

A hand-held portable wet/dry vacuum comprising a cleaning fluid tank, a motor housing and a dirty fluid tank. The cleaning fluid tank is selectively mounted on the motor housing. A siphon, which is controlled by an actuator, is located in the cleaning fluid tank. The dirty fluid tank is selectively mounted on the motor housing in spaced relation to the cleaning fluid tank. The motor housing houses an air driven turbine and a suction fan and motor assembly. A suction nozzle is located at a first end of the wet/dry vacuum. An air passageway extends from the suction nozzle to the suction fan and motor. The turbine communicates with the air passageway. The housing further comprises at least one air inlet to allow air to pass to the turbine. A brush is operably connected to the turbine via a gear train. A rotational axis of the brush is angled so that a portion of the brush contacts a surface to be cleaned. At least one air inlet is found in a wall of the motor housing for allowing cooling air into the motor housing. A valve is located in the air passageway and switches airflow between the turbine and the suction nozzle. Alternatively, an electric motor is used in lieu of the turbine to power the brush.

28 Claims, 10 Drawing Sheets

HAND-HELD WET/DRY VACUUM

BACKGROUND OF THE INVENTION

The present invention relates to a portable wet/dry vacuum cleaner. More particularly, the present invention relates to a hand-held wet/dry vacuum with a powered rotary brush for applying cleaning fluid and suctioning dirt and debris from carpets, floors, and above-floor surfaces.

Portable hand-held vacuum cleaners have become extremely popular for cleaning a variety of surfaces in homes, offices, cars or wherever there are hard-to-reach places. These portable vacuum cleaner units are relatively light weight and have a handle in order to enable a user to readily utilize them in places where canister, upright or shop-type vacuum cleaners cannot be used. As will be appreciated, these portable vacuum cleaners are utilized typically for small clean-up jobs or hard-to-reach places.

While such prior art portable hand-held vacuum cleaners have worked well for their intended purposes, they have been primarily useful for picking up light weight dry debris, such as dust and small particulate matter. Where heavier and more dense particulate matter is encountered, they have been less effective. In fact, even where dust or other lighter particulate matter are desired to be picked up or collected, the overall efficiency and effectiveness of the prior vacuum cleaners has been less than desired.

Many prior art portable vacuum cleaners were also not constructed for picking up or collecting wet debris, such as liquid spills. For example, the filters and motors of some of the prior art portable vacuum cleaners would unnecessarily be exposed and/or not adapted to wet debris.

Another limiting factor of some prior art portable vacuums is the efficiency and effectiveness of the airflow path through the vacuum cleaner units, while depositing debris in a debris canister or container. Most of the prior art vacuum cleaner units do not deposit the debris in a debris canister or container separate from an air communication channel, while maintaining an efficient airflow path or communication channel throughout the unit.

Some prior art wet/dry vacuum cleaner units do not include brushes which would help work a cleaning fluid into the surface being cleaned prior to vacuuming. Many wet/dry vacuum cleaners do not even have a container for cleaning fluid. Those vacuum cleaner units which do have brushes usually actuate the brushes while a suction is being drawn thereby splitting the power of the motor for both tasks.

Other hand-held vacuums are difficult to use in that they are awkward to service. Others are expensive to produce in that they have complex reciprocating brush mechanisms.

Accordingly, it is desirable to develop a new and improved hand-held wet/dry vacuum which would overcome the foregoing deficiencies and others while meeting the above-stated needs and providing better and more advantageous overall results.

SUMMARY OF THE INVENTION

The present invention relates to a new and improved hand-held wet/dry vacuum. More specifically, the wet/dry vacuum has a powered brush for working cleaning fluid into a surface to be cleaned and a spray nozzle for distributing cleaning fluid onto the surface to be cleaned.

In the preferred embodiment, the hand-held portable wet/dry vacuum comprises a body having a first end and a second end, a suction nozzle located at the body first end, a cleaning fluid tank, a motor housing, and a dirty fluid tank.

The cleaning fluid tank is selectively mounted on the motor housing. If desired, the cleaning fluid tank comprises a handle portion. At least a portion of the suction nozzle is of one piece with the cleaning fluid tank.

A siphon is located within the cleaning fluid tank. The siphon siphons cleaning fluid from the cleaning fluid tank for distribution onto a surface to be cleaned. A siphon actuator is connected to the siphon for operating the siphon. A spray tube is connected to the siphon for distributing cleaning solution onto the surface to be cleaned.

A dirty fluid tank is selectively mounted on the motor housing in spaced relation to the cleaning fluid tank. The dirty fluid tank further comprises a drain cap that covers an opening for draining the dirty fluid tank. If desired, the dirty fluid tank is wedge-shaped to elevate the motor housing above the suction nozzle to prevent liquid from entering the suction motor.

The motor housing preferably houses an air driven turbine along with a suction fan and motor assembly. An air passageway extends from the suction nozzle to the suction fan and motor. The turbine communicates with the air passageway. The housing comprises at least one air inlet to allow air to pass to the turbine. The brush is operably connected to the turbine. If desired, a gear train drivingly connects the turbine to the brush. A rotational axis of the brush is angled so that only a portion of the brush contacts a surface to be cleaned.

A valve is located in the air passageway which switches airflow between the turbine and the suction nozzle. A switch is located on the motor housing and is operably connected to the valve to control movement of the valve.

At least one air inlet is provided in a wall of the motor housing for allowing cooling air into the motor housing. The inlet is located on a plane spaced above a plane of the air passageway to prevent liquid from entering the motor.

One advantage of the present invention is the provision of a new and improved hand-held wet/dry vacuum.

Another advantage of the present invention is the provision of a hand-held wet/dry vacuum that includes a turbine and a suction fan and motor within a single housing.

Still another advantage of the present invention is the provision of a hand-held wet/dry vacuum including an onboard cleaning fluid container which can be selectively separated from the remainder of the vacuum.

Yet another advantage of the present invention is the provision of a hand-held wet/dry vacuum including a valve that switches airflow between the turbine in a first position and the suction nozzle in a second position. When the valve is in the first position, only the brush is actuated and no suction is drawn at the nozzle. When the valve is in the second position, the brush is inactivated and all of the airflow is directed to the suction nozzle, maximizing efficiency of the nozzle. In this position, the valve prevents liquid from entering the suction fan and motor, thus eliminating the need for a filter.

A further advantage of the present invention is the provision of a hand-held wet/dry vacuum including a brush which is angled with respect to a surface to be cleaned to reduce wear on the brush and prevent over stressing the turbine and gear assembly.

A yet further advantage of the present invention is the provision of a hand-held wet/dry vacuum including a cleaning fluid tank with an integrated siphon to siphon cleaning fluid from the bottom of the tank.

A still yet further advantage of the present invention is the provision of a hand-held wet/dry vacuum including a wedge-shaped dirty fluid tank to elevate a motor housing above a suction nozzle to prevent liquid from entering the turbine and the suction motor.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENTS

Figure 1:
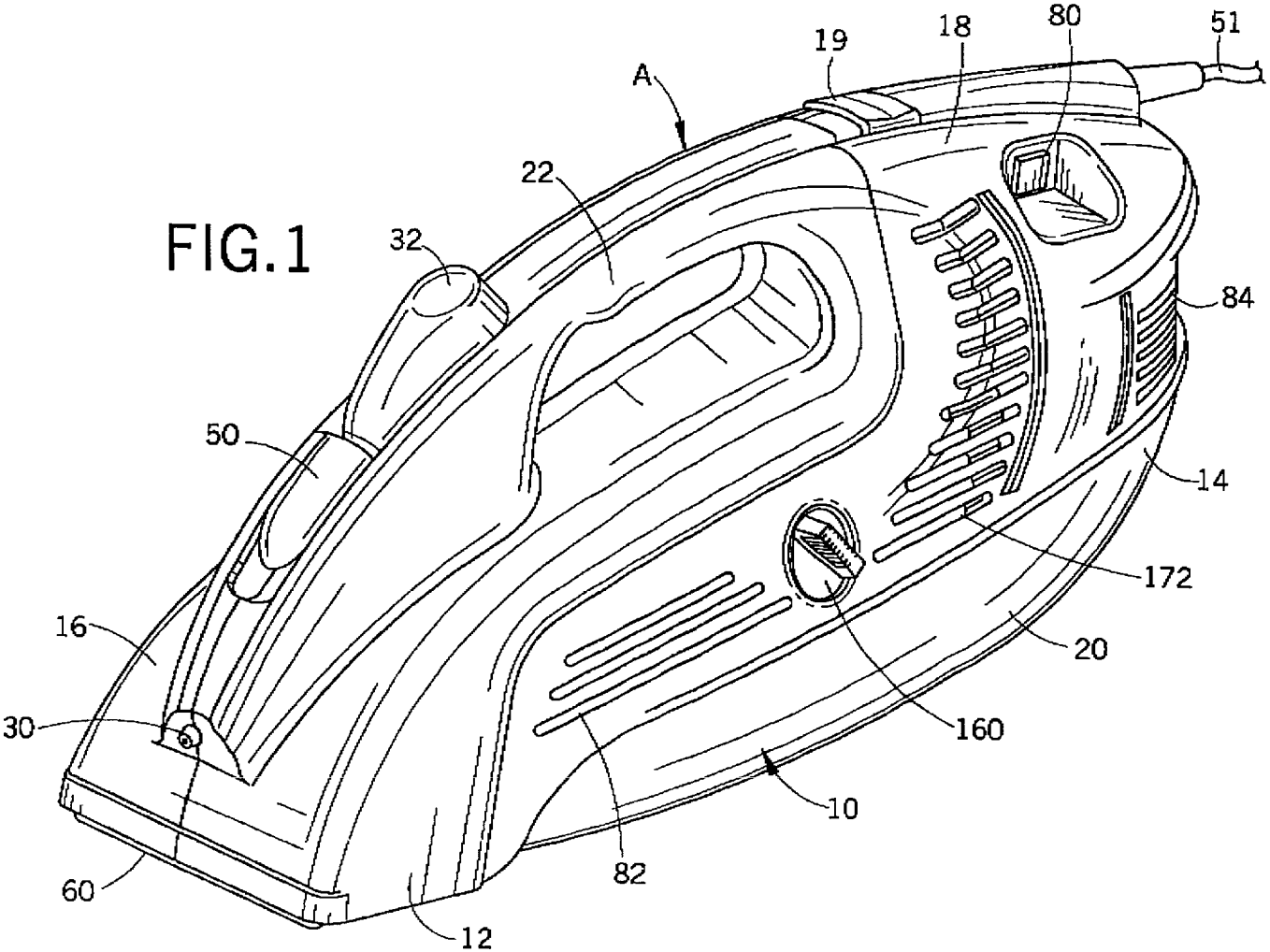
FIG. 1 is a perspective view of the hand held wet/dry vacuum according to a first preferred embodiment of the present invention.

Referring now to the drawings, wherein the showings are for purposes of illustrating preferred embodiments of this invention only and not for purposes of limiting same, FIG. 1 shows a hand held wet/dry vacuum A according to a first preferred embodiment of the present invention.

The hand held wet/dry vacuum A includes a body 10 having a first end 12 and a second end 14. The wet/dry vacuum includes a cleaning fluid tank 16, a motor housing 18 and a dirty fluid tank 20. The cleaning fluid tank 16 can be made from clear thermoplastic material. The motor housing 18 can be made from thermoplastic material. The dirty fluid tank 20 may be made from a transparent material.

Figure 2:
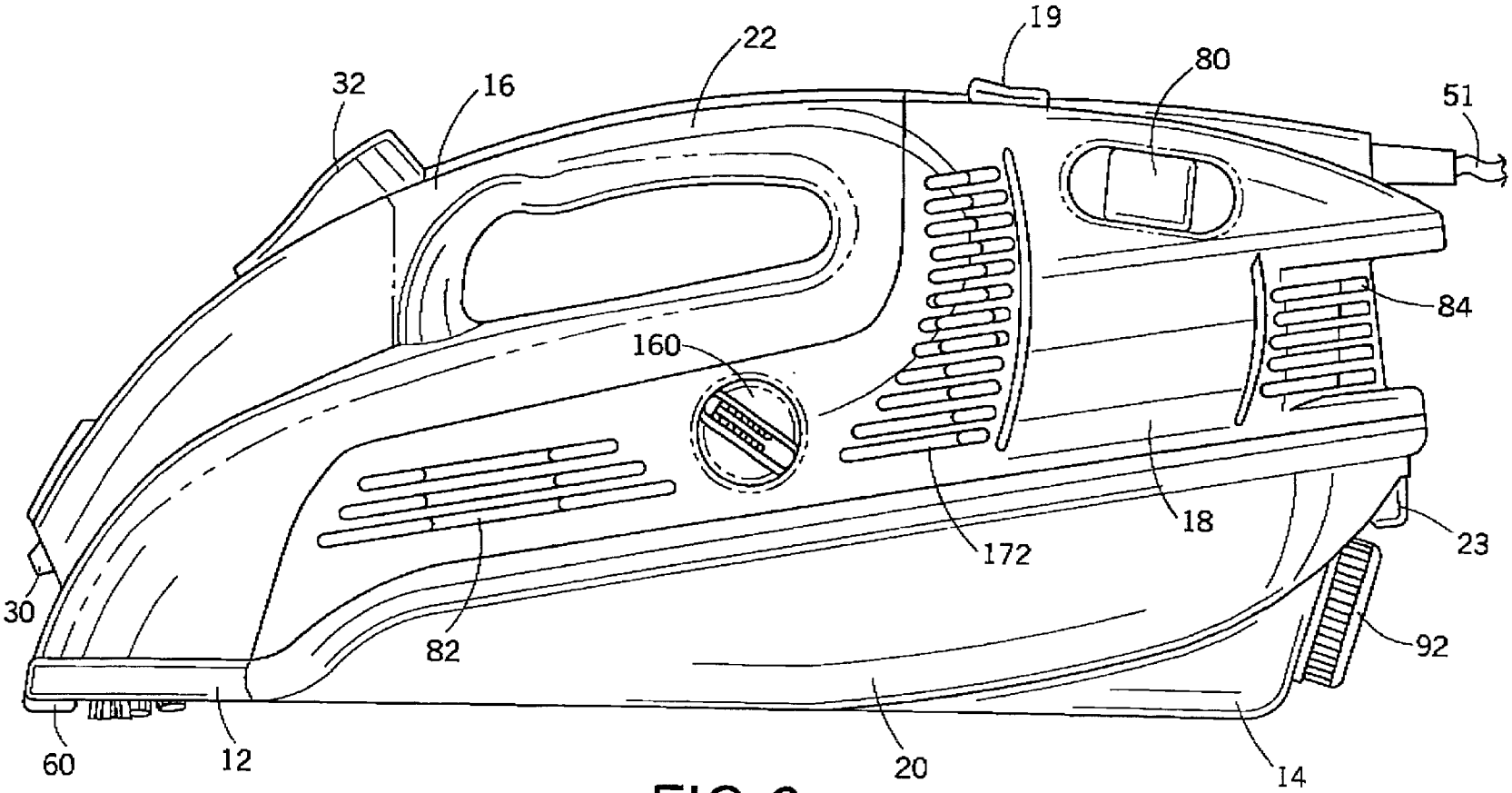
FIG. 2 is a side elevational view of the wet/dry vacuum cleaner of FIG. 1.

Referring to FIG. 2, the cleaning fluid tank 16 is selectively mounted onto the motor housing 18 by a releasable latch 19. When the latch 19 is depressed, it is released from a catch 21 (shown on FIG. 8) on the cleaning fluid tank, thus allowing the cleaning fluid tank 16 to be removed from the motor housing 18.

The dirty fluid tank 20 is selectively mounted onto the motor housing 18 in spaced relation to the cleaning fluid tank 16. The dirty fluid tank 20 is mounted onto the motor housing 18 by a latch 23. When the latch 23 is depressed, it is released from a catch 25 (shown on FIG. 8) on the motor housing, thus allowing the dirty fluid tank to be removed from the motor housing. If desired, the dirty fluid tank 20 may be positioned on an opposite side of the motor housing 18 from the cleaning fluid tank 16. A handle portion 22 is preferably formed as part of the cleaning fluid tank 16.

Figure 3:
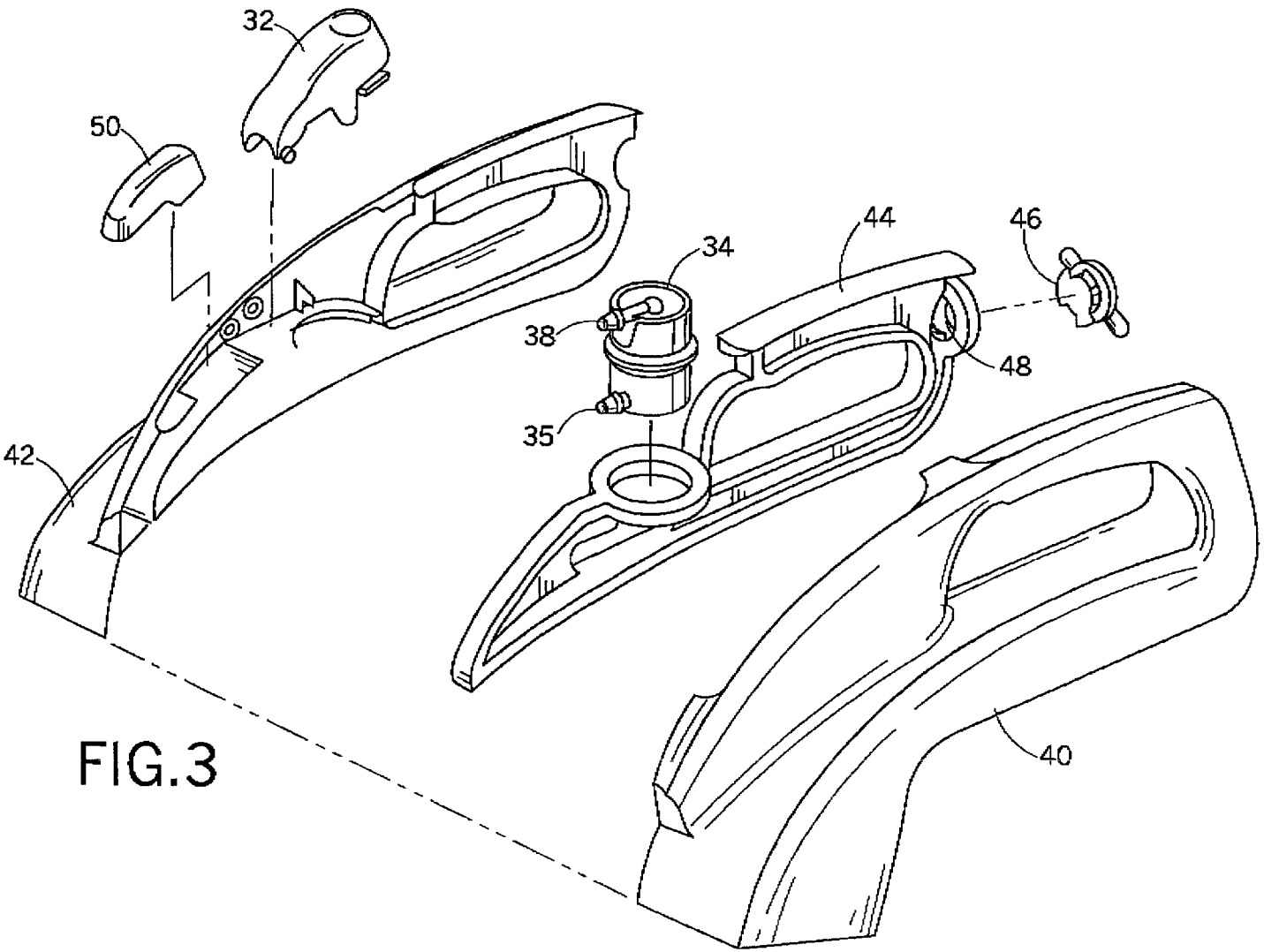
FIG. 3 is an exploded perspective view of a cleaning fluid tank of the hand held wet/dry vacuum of FIG. 1.

The cleaning fluid tank 16 further includes a spray nozzle 30 for releasing cleaning solution onto a surface to be cleaned. With reference now to FIG. 3, a siphon actuator 32 is depressed which causes a siphon 34 to siphon cleaning liquid from the bottom of the cleaning fluid tank through an inlet port 35 to an outlet port 38 positioned above the inlet port.

The cleaning fluid tank is comprised of several pieces, including a left portion 40 and a right portion 42. A glue channel 44 is used to secure the left portion 40 and the right portion 42 together. A cap 46 is mounted within an opening 48 in the cleaning fluid tank. The cap 46 is removed so that cleaning fluid may be added to the cleaning fluid tank. A cord clip 50 is mounted on a top surface of the cleaning fluid tank for securing a power cord 51 (See FIG. 1).

Figure 4:
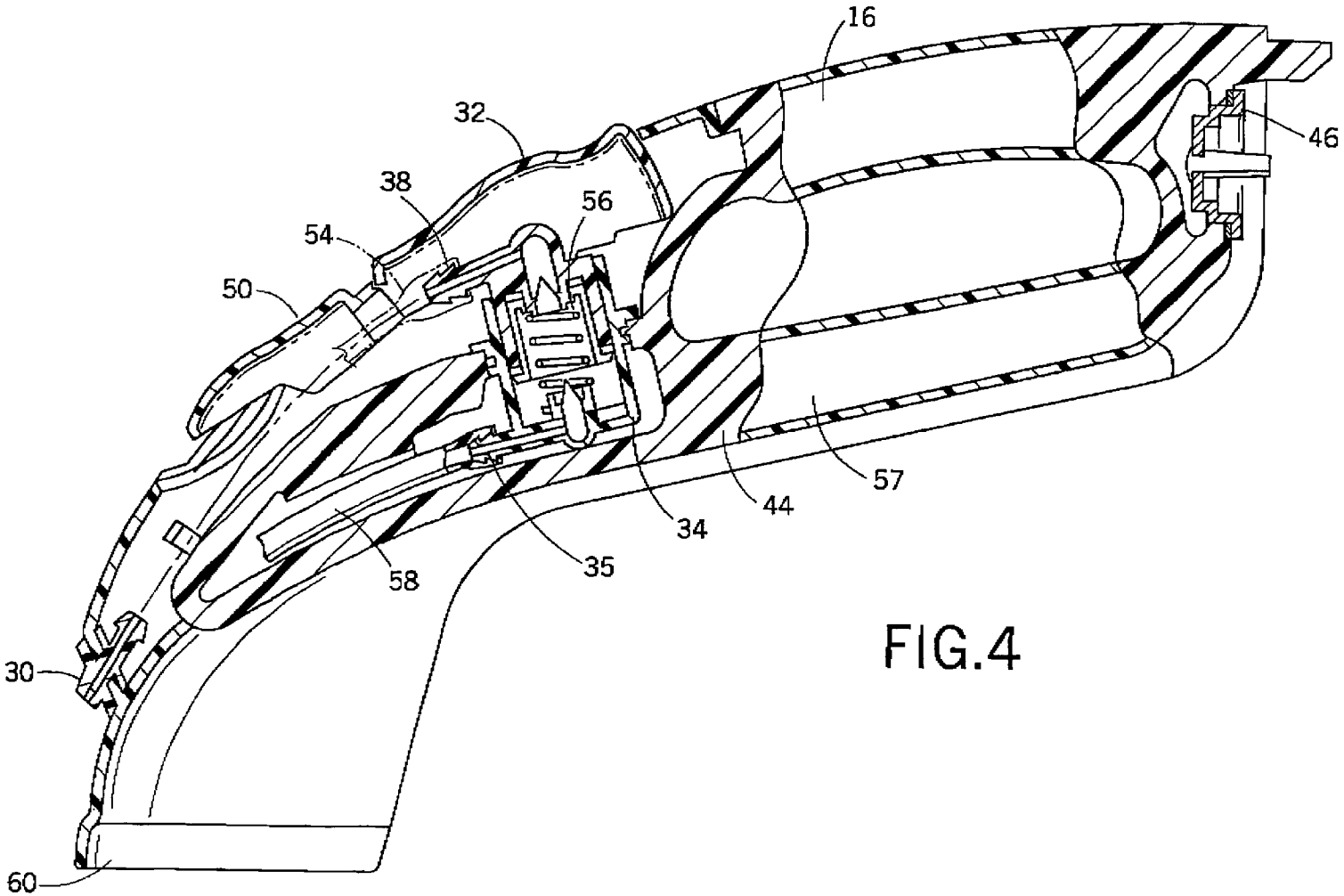
FIG. 4 is an enlarged side elevational view in cross section of the cleaning fluid tank and a part of a suction nozzle of the hand held wet/dry vacuum of FIG. 1.

Referring now to FIG. 4, the spray nozzle 30 is connected to a spray tube 54 which is connected to the outlet port 38. As the actuator 32 is depressed, a spring mechanism 56 is compressed, creating a vacuum or siphon. Cleaning fluid is siphoned from a reservoir 57 through a tube 58 up into the inlet port 35 and up to outlet port 38, and then flows by gravity through the spray tube 54 to the spray nozzle 30 onto the surface to be cleaned.

A suction nozzle 60 is located adjacent the first end 12 of the body 10. A portion of a suction nozzle 60 is of one piece with the cleaning fluid tank 16. The suction nozzle 60 is used for suctioning debris and soiled cleaning liquid from the surface to be cleaned.

Figure 5:
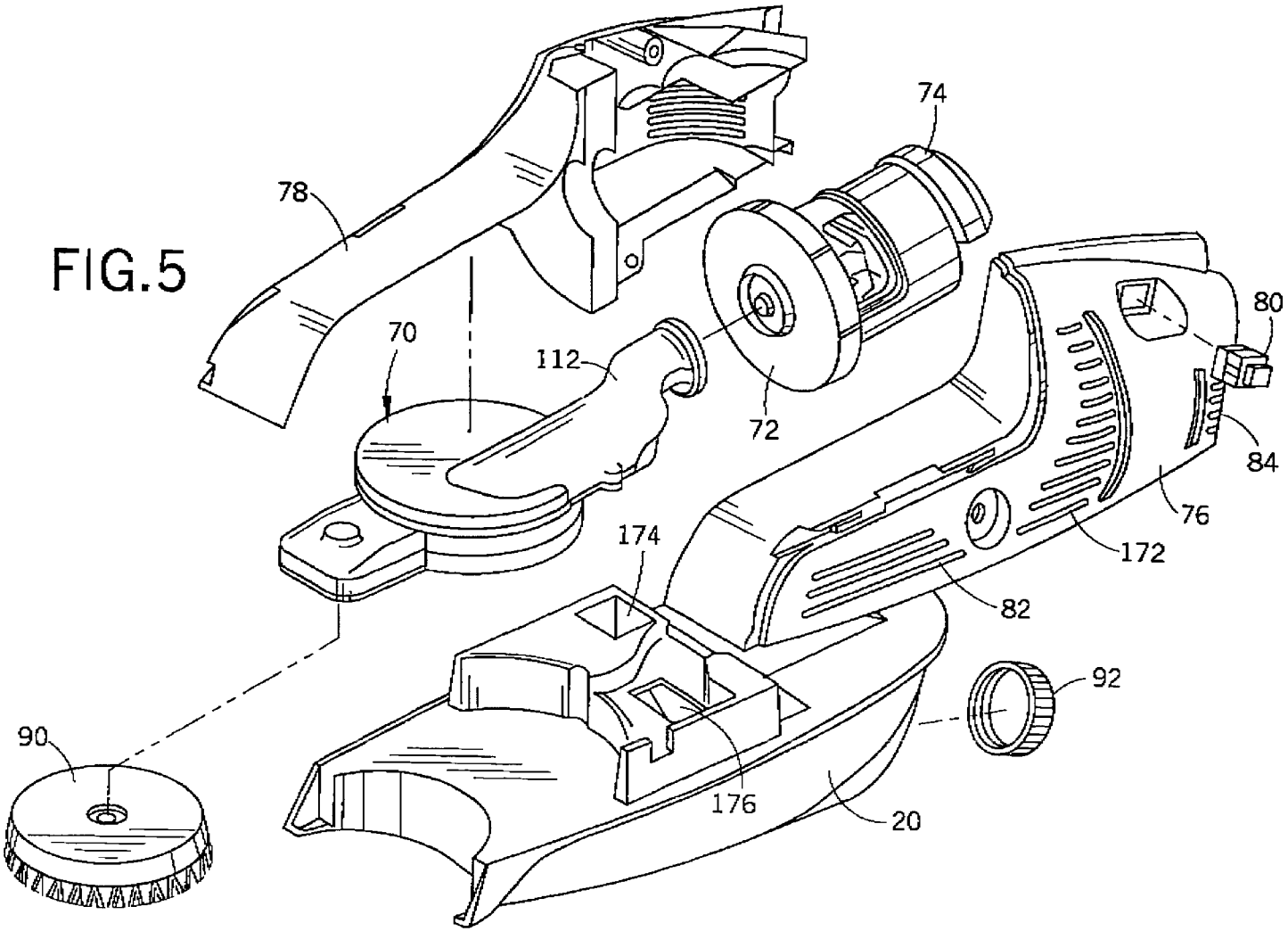
FIG. 5 is an exploded perspective view of a motor housing and a dirty fluid tank of the hand held wet/dry vacuum of FIG. 1.

Referring now to FIG. 5, the motor housing 18 houses an air driven turbine assembly 70, and a suction fan 72 and motor 74. The motor housing 18 is comprised of a left half 76 and a right half 78 which are suitably secured together. A power switch 80 activates the suction motor and fan. At least one air inlet 82 is provided on each of the left and right halves 76 and 78 of the housing to provide air to the turbine 70 to rotate the turbine. At least one air inlet 84 is provided on the motor housing 18 for providing cooling air from atmosphere to the motor 74 as drawn in by a cooling fan 89.

Figure 8:
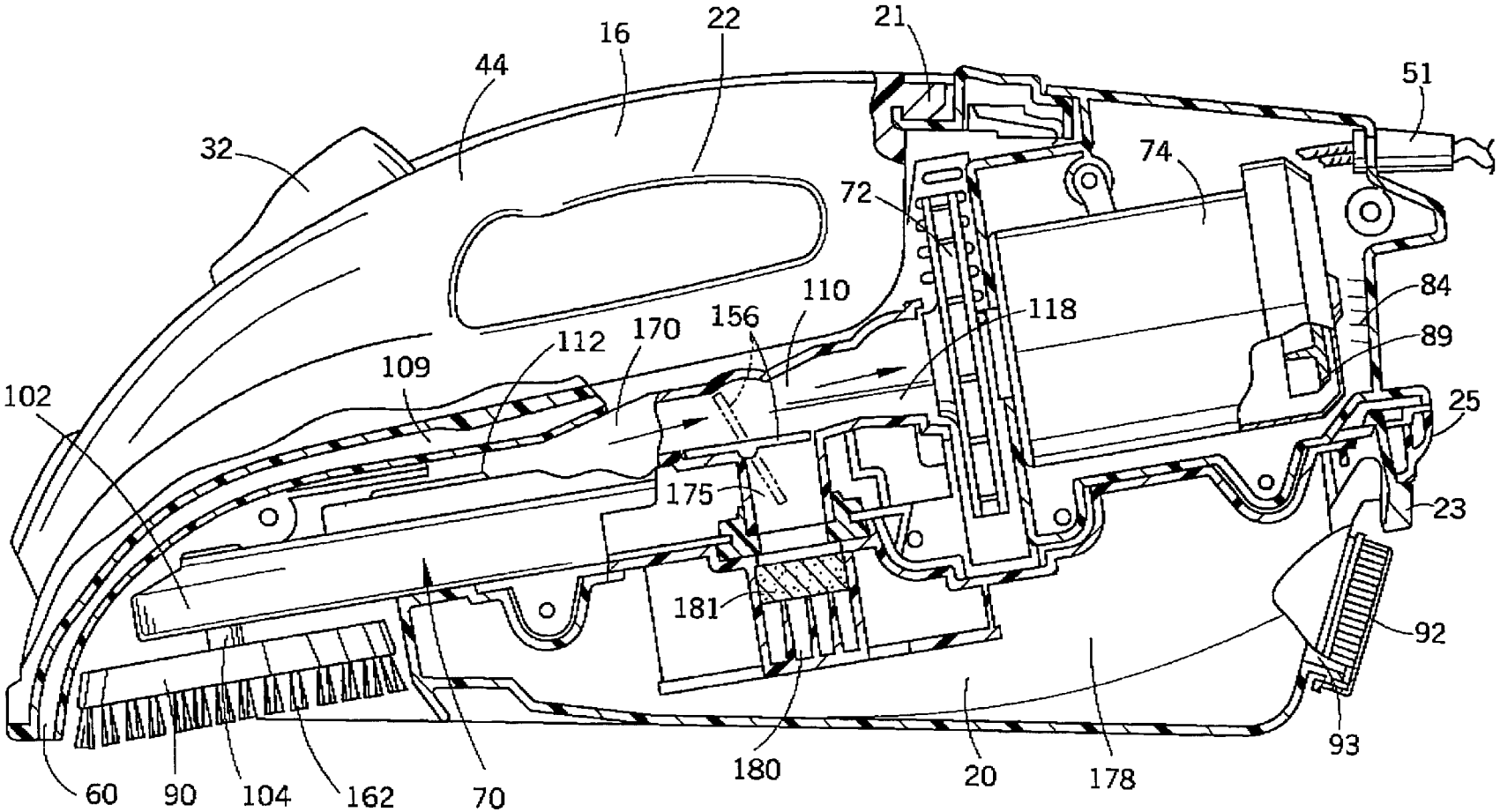
FIG. 8 is a side elevational view in cross-section of the hand held wet/dry vacuum of FIG. 1 illustrating a brush, turbine and suction motor assembly.

With reference now to FIG. 8, a brush 90 is operably connected to the turbine assembly 70. If desired, the dirty fluid tank 20 is mounted onto a bottom surface of the motor housing 18. A drain cap 92 is provided for sealing a drain opening 93 in the dirty fluid tank 20. The drain cap 92 is removed when the dirty fluid tank is to be emptied.

Figure 6:
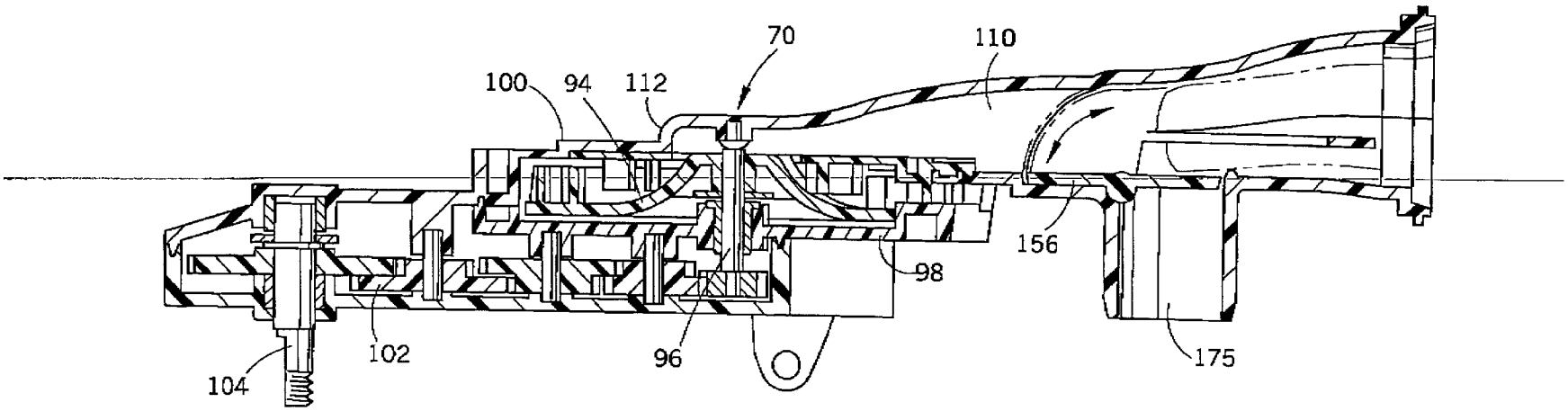
FIG. 6 is an enlarged side elevational view in cross-section of a gear train and the turbine of the hand held wet/dry vacuum of FIG. 1.

Referring to FIG. 6, the turbine assembly 70 includes a turbine rotor 94 which is mounted on a shaft 96. The turbine assembly further includes a first wall 98 and a second wall 100 spaced apart from and generally parallel to the first wall. The shaft 96 extends through the first wall and connects to a reduction gear train 102. The gear train 102 drivingly connects the turbine rotor 94 to a drive shaft 104 of the brush 90.

As shown in FIG. 8, a first air passageway 109 extends from the suction nozzle 60 to an air inlet of the dirty fluid tank 20. A second air passageway 110 extends from an outlet of the dirty fluid tank 20 to the suction fan 72. The turbine 70 communicates with the second air passageway 110. The first air passageway 109 and second air passageway 110 are laterally spaced from each other.

Figure 7:
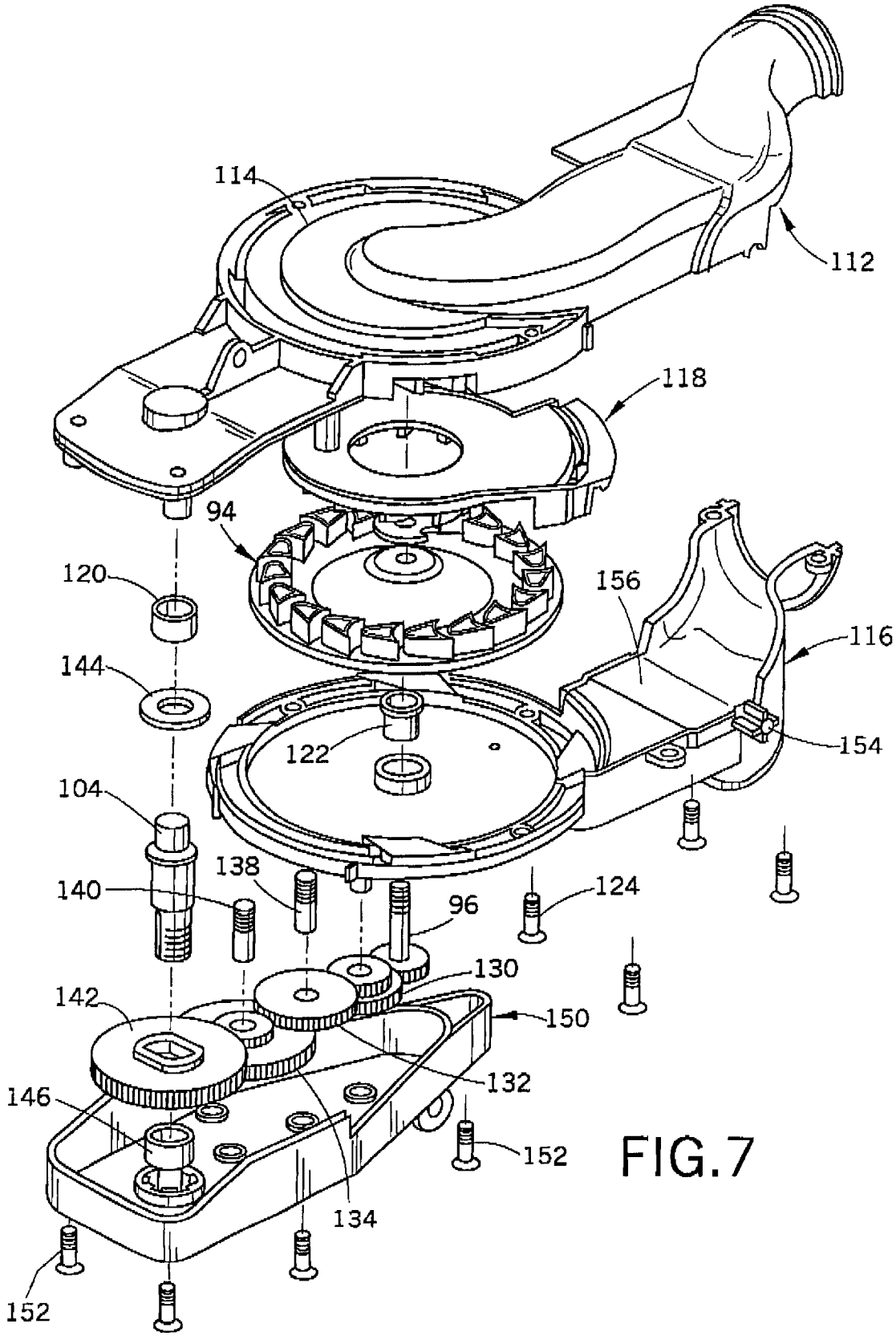
FIG. 7 is an enlarged, exploded perspective view of the turbine assembly of the hand held wet/dry vacuum of FIG. 1.

Referring now to FIG. 7, the turbine assembly 70 includes a turbine shroud 112 including a top portion 114 and a bottom portion 116, the turbine rotor 94, and a stator plate 118 are positioned between the shroud top portion 114 and the rotor 94. A bearing assembly 120, 122 surrounds the shaft 96 of the rotor 94. Fasteners 124 secure the top portion 114 to the bottom portion 116.

The conventional gear train assembly 102 includes a series of stepped gears 130, 132, 134 which matingly engage each other. The series of gears are mounted on shafts 96, 138, 140. The gear train extends between the shaft 96 of the turbine rotor 94 to an output gear 142. The output gear 142 includes a thrust washer 144 which surrounds a bearing 146 for the drive shaft 104 which is connected to the output gear. A gear cover 150 surrounds the gear train and is secured to the turbine cover by fasteners 152.

A valve 154 is located within the air passageway 110 to switch airflow between the turbine rotor 94 and the suction nozzle 60. By switching airflow from the turbine to the suction nozzle, the brush 90 is prevented from needlessly rotating during suction of the liquid and debris from the surface being cleaned. Secondly, all of the airflow is supplied to the suction nozzle 60 to maximize the suction power of the nozzle.

The valve 154 includes a flap door 156 which is pivoted between a first position (airflow to the turbine) and a second position (airflow to the suction nozzle). A switch 160 (shown on FIGS. 1 and 2) located on the motor housing is operably connected to the valve 154 to control movement of the valve 154 between the first position and the second position.

Referring to FIG. 8, the gear train 102 drivingly connects the turbine rotor 94 to the brush 90. The rotational axis of the brush 90 is angled with respect to the surface to be cleaned so that only a portion of the brush 90 contacts the surface to be cleaned. This prevents over stressing the turbine and gears while driving the brush as well as reducing wear of bristles 162 of the brush.

If desired, the dirty fluid tank 20 is wedge shaped to elevate the motor housing 18 with respect to the suction nozzle 60. Thus, any liquid which is sucked into the suction nozzle will drip into the dirty fluid tank 20 and only air will pass to the suction fan 72 and motor 74. The inlet 84 is located on a plane which is spaced above a plane of the air passageway 110 to prevent liquid from entering the suction motor 74.

FIG. 8 illustrates the air flow that occurs when the valve 154 and door flap 156 are in the first position. Air flows in through the inlets 82 into the turbine assembly causing the turbine rotor 94 to rotate. The air then travels through the air passageway 110 to the suction fan 72 and suction motor 74.

Figure 9:
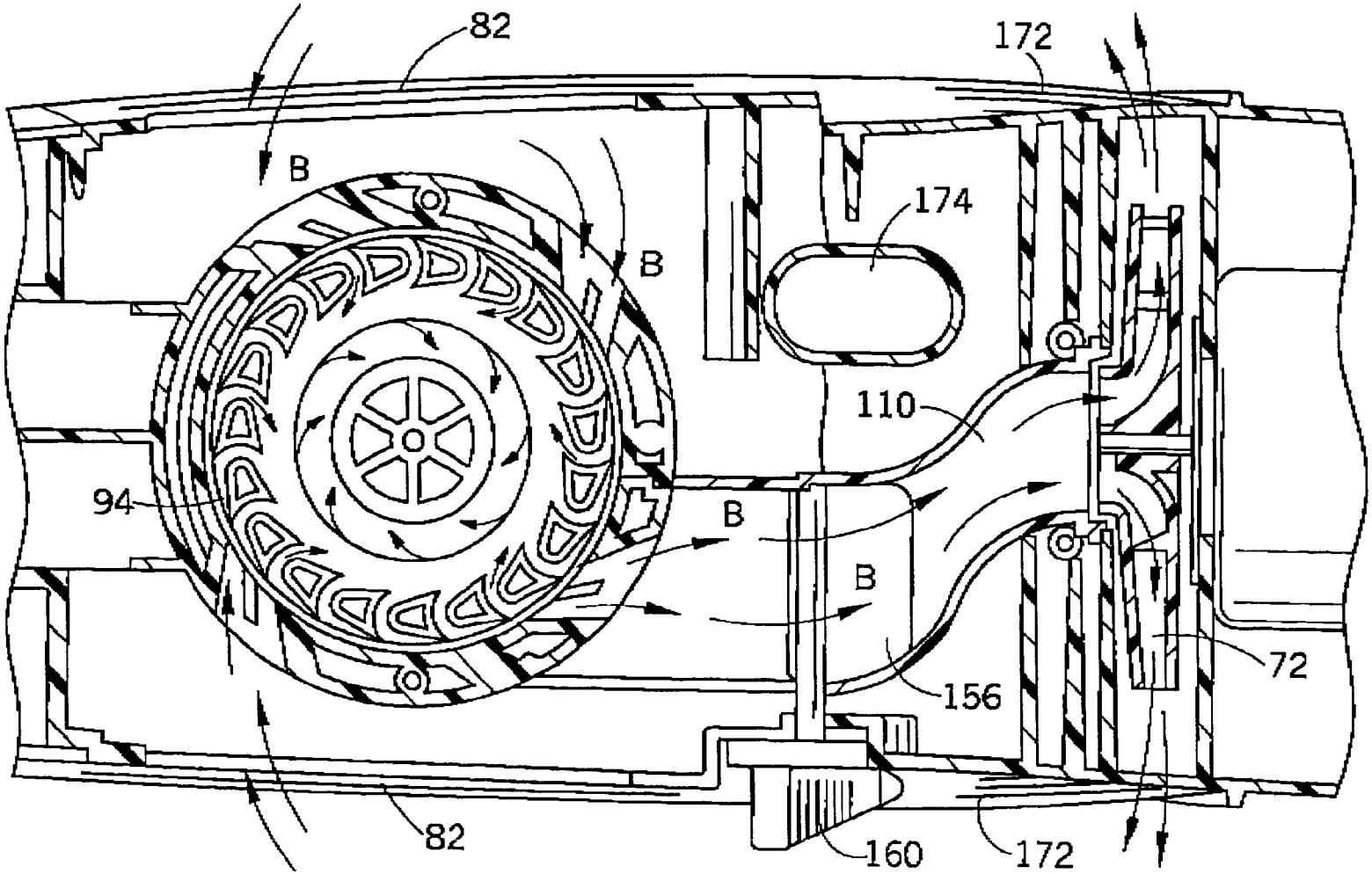
FIG. 9 is a top plan view, in cross section, illustrating the turbine assembly and an airflow passageway of the hand held wet/dry vacuum of FIG. 1.

Referring to FIG. 9, when the valve flap door 156 is in a first position, airflow (shown by arrows B) is switched to the turbine rotor 94 and brush 90. Thus, there is no airflow through the suction nozzle 60 and no suction occurs at the nozzle. Since the airflow is directed to the turbine, a negligible amount of suction occurs at the nozzle. Any suction would be insufficient to draw debris or soiled cleaning fluid up into the suction nozzle or air passageway.

Air enters through inlet vents 82 to the turbine housing. The air enters the turbine housing causing the rotor 94 to rotate. The gear train 102 connects the rotor to the brush 90, thus causing the brush to rotate. Air then passes through an exhaust channel 170 of the turbine into the air passageway 110. The air then enters the suction fan 72 and motor 74 and passes through the exhaust vents 172 located in the motor housing (shown in FIGS. 1 and 2).

Referring to FIG. 8, when the valve flap door 156 is in a second position (shown in phantom in FIG. 8), airflow is switched to the suction nozzle 60. The valve blocks airflow through the turbine, thus the turbine rotor 94 and brush 90 do not rotate. Air, debris and soiled cleaning fluid flow through the suction nozzle 60 into the air passageway 109, over the turbine shroud 112 and into the dirty fluid tank through an inlet 174 (shown in FIG. 9) of the dirty fluid tank. The air and liquid mixture is blocked from traveling to the suction fan and motor by the valve flap door 156. Thus, no filter is required. The liquid then drips into a reservoir 178 of the dirty fluid tank 20. A cage 180 is positioned below the inlet 174 and a float 181 therein gradually rises to the opening as more liquid accumulates in the dirty fluid tank. When the float 181 reaches a duct 175, which engages an outlet 176 of the dirty fluid tank (as shown in FIG. 8), the dirty fluid tank is full and needs to be emptied. When the dirty fluid tank is not full, air then travels out of the dirty fluid tank around the float 181 and through outlet 176 to the suction fan 72 and motor 74. The air then passes through the air passageway 110 to the suction fan 72 and out through the exhaust vents 172 to atmosphere.

Figure 10:
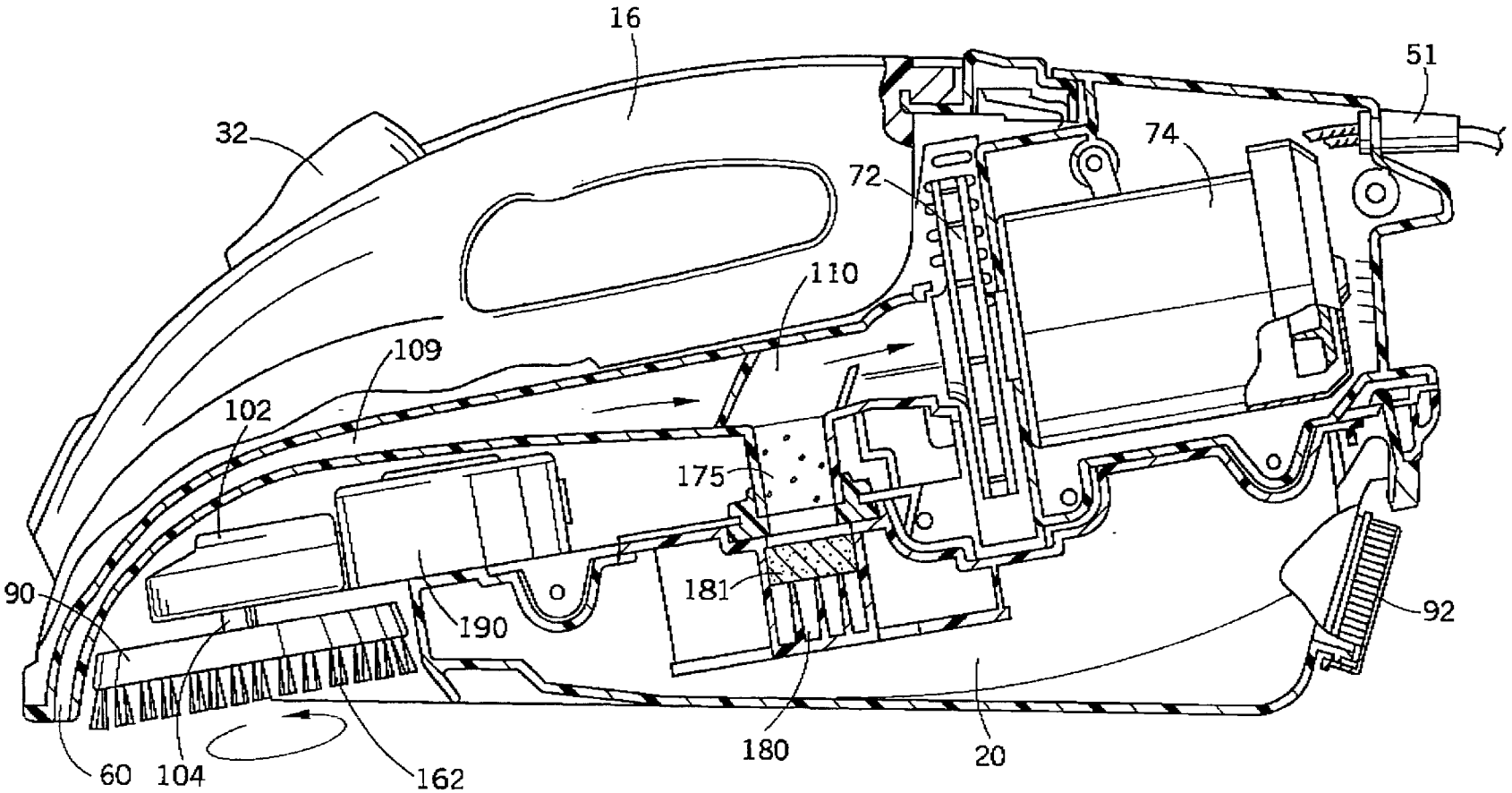
FIG. 10 is a side elevational view in cross section of a hand-held wet/dry vacuum according to a second preferred embodiment of the present invention employing an electric motor for powering a brush assembly.

Alternatively, referring now to FIG. 10, an electric motor 190 may be used in lieu of the air-driven turbine to power the brush 90. The gear train 102 drivingly connects the electric motor 190 to the brush 90. By employing the gear train 102, the size of the electric motor 190 can be reduced. In this embodiment, there is no need for the valve since all of the airflow is used only with the suction nozzle.

The invention has been described with reference to the preferred embodiments. Obviously, alterations and modifications will occur to others upon a reading and understanding of this specification. It is intended to include all such modifications and alterations insofar as they come within the scope of the appended claims or the equivalents thereof.

What is claimed is:

1. A hand-held portable wet/dry vacuum comprising:

a cleaning fluid tank;

a motor housing, wherein said cleaning fluid tank is selectively mounted on said motor housing;

a dirty fluid tank selectively mounted on said motor housing in spaced relation to said cleaning fluid tank;

wherein said motor housing houses an air driven turbine and a suction fan and motor assembly;

a suction nozzle located at a first end of said cleaning fluid tank;

an air passageway extending from said suction nozzle to said suction fan and motor assembly, wherein said turbine communicates with said air passageway, wherein said housing comprises at least one air inlet to allow air to pass to said turbine;

a brush, wherein said brush is operably connected to said turbine; and a valve located in said air passageway, wherein said valve switches airflow between said turbine and said suction nozzle.

2. The hand-held portable wet/dry vacuum of claim 1 further comprising a gear train, wherein said gear train drivingly connects said turbine to said brush.

3. The hand-held portable wet/dry vacuum of claim 1 wherein a rotational axis of said brush is angled so that a portion of the brush contacts a surface to be cleaned.

4. The hand-held portable wet/dry vacuum of claim 1 further comprising at least one air inlet in a wall of said motor housing for allowing cooling air into said motor housing, said inlet is located on a plane spaced above a plane of said air passageway to prevent liquid from entering said motor assembly.

5. The hand-held portable wet/dry vacuum of claim 1 further comprising a siphon located within said cleaning fluid tank, wherein said siphon siphons cleaning fluid for distribution onto a surface to be cleaned.

6. The hand-held portable wet/dry vacuum of claim 5 further comprising a siphon actuator connected to said siphon for operating said siphon.

7. The hand-held portable wet/dry vacuum of claim 6 comprising a spray tube connected to said siphon for distributing cleaning fluid onto a surface to be cleaned.

8. The hand-held portable wet/dry vacuum of claim 1 wherein said dirty fluid tank further comprises a drain cap that covers an opening for draining said dirty fluid tank.

9. The hand held portable wet/dry vacuum of claim 1 further comprising a switch located on said motor housing, wherein said switch is operably connected to said valve to control movement of said valve.

10. The hand held portable wet/dry vacuum of claim 1 wherein said cleaning fluid tank comprises a handle portion.

11. The hand held portable wet/dry vacuum of claim 1 wherein said motor housing is positioned on a top surface of said dirty fluid tank, wherein said dirty fluid tank is wedge shaped to position said motor housing above said suction nozzle.

12. The hand held portable wet/dry vacuum of claim 1 wherein at least a portion of said suction nozzle is of one piece with said cleaning fluid tank.

13. A hand held wet/dry vacuum comprising:

a cleaning fluid tank, said cleaning fluid tank comprising a siphon located within said tank, wherein said siphon withdraws cleaning fluid from said tank for distribution onto a surface to be cleaned;

a motor housing, wherein said cleaning fluid tank is selectively mounted on one side of said motor housing;

a dirty fluid tank selectively mounted on said motor housing on an opposite side from said cleaning fluid tank;

a brush, wherein said brush is operably connected to a means for powering said brush;

wherein said motor housing houses a suction fan and motor assembly;

a suction nozzle located at a first end of said cleaning fluid tank; and an air passageway extending from said suction nozzle to said suction fan and motor assembly.

14. The hand-held wet/dry vacuum of claim 13 further comprising a gear train, wherein said gear train drivingly connects said means for powering said brush to said brush.

15. The hand-held wet/dry vacuum of claim 13 wherein a rotational axis of said brush is angled so that a portion of the brush contacts a surface to be cleaned.

16. The hand-held wet/dry vacuum of claim 13 further comprising at least one air inlet in a wall of said motor housing for allowing cooling air into said motor housing, said inlet is located on a plane spaced above a plane of said air passageway to prevent liquid from entering said motor assembly.

17. The hand-held wet/dry vacuum of claim 13 further comprising a siphon actuator connected to said siphon for operating said siphon.

18. The hand-held wet/dry vacuum of claim 17 comprising a spray tube connected to said siphon for distributing cleaning fluid onto a surface to be cleaned.

19. A hand held wet/dry vacuum comprising:

a motor housing which houses a suction fan and motor;

a motor housing which houses a suction fan and motor;

a suction nozzle located adjacent said motor housing;

a cleaning fluid tank selectively mounted to said motor housing, said cleaning fluid tank comprising:

a handle portion which is integral to the cleaning fluid tank, at least a portion of said suction nozzle is of one piece with said cleaning fluid tank, a latch to secure said cleaning fluid tank to said motor housing, wherein said handle portion of said cleaning fluid tank serves as a handle for the hand held wet/dry vacuum when said cleaning fluid tank is secured to said motor housing;

a dirty fluid tank selectively mounted on a bottom surface of said motor housing in spaced relation to said cleaning fluid tank, wherein said dirty fluid tank is wedge shaped to position said motor housing above said suction nozzle;

a brush, wherein said brush is operably connected to a means for powering said brush; and an air passageway extending from said suction nozzle to said suction fan and motor.

20. The hand-held wet/dry vacuum of claim 19 further comprising a gear train, wherein said gear train drivingly connects said means for powering said brush to said brush.

21. The hand-held wet/dry vacuum of claim 19 wherein a rotational axis of said brush is angled so that a portion of the brush contacts a surface to be cleaned.

22. The hand-held wet/dry vacuum of claim 19 further comprising at least one air inlet in a wall of said motor housing for allowing cooling air into said motor housing, said inlet is located on a plane spaced above a plane of said air passageway to prevent liquid from entering said motor.

23. The hand-held wet/dry vacuum of claim 19 further comprising a siphon located within said cleaning fluid tank, wherein said siphon siphons cleaning fluid for distribution onto a surface to be cleaned.

24. The hand-held wet/dry vacuum of claim 23 further comprising a siphon actuator connected to said siphon for operating said siphon.

25. The hand-held wet/dry vacuum of claim 24 comprising a spray tube connected to said siphon for distributing cleaning fluid onto a surface to be cleaned.

26. A hand-held portable wet/dry vacuum comprising:

a cleaning fluid tank;

a motor housing, wherein said cleaning fluid tank is selectively mounted on said motor housing;

a dirty fluid tank selectively mounted on said motor housing in spaced relation to said cleaning fluid tank;

a suction fan and motor assembly located within said motor housing;

a suction nozzle located at a first end of the portable wet/dry vacuum, wherein said dirty fluid tank is wedge-shaped to position said motor housing above said suction nozzle; and, an air passageway communicating said suction nozzle with said suction fan and motor assembly.

27. The hand-held portable wet/dry vacuum of claim 26 further comprising a brush mounted on said motor housing.

28. The hand-held portable wet/dry vacuum of claim 27 further comprising a means for powering said brush, said means for powering being located in said motor housing.

* * * * *